US007810259B1

(12) United States Patent
Goldman

(10) Patent No.: US 7,810,259 B1
(45) Date of Patent: Oct. 12, 2010

(54) SNOW PUSHER WITH A REMOVABLE FRICTION-REDUCING EDGE

(76) Inventor: Marc Goldman, 1401 Teally Pl., El Dorado Hills, CA (US) 95762

( * ) Notice: Subject to any disclaimer, the term of this patent is extended or adjusted under 35 U.S.C. 154(b) by 0 days.

(21) Appl. No.: 12/290,363

(22) Filed: Oct. 29, 2008

(51) Int. Cl.
*E01H 5/02* (2006.01)

(52) U.S. Cl. ..... 37/285

(58) Field of Classification Search ..... 37/265, 37/284, 285, 264, 278, 273; 172/354, 358, 172/365; 294/54.4, 57, 53.5, 54.5, 49, 58, 294/59

See application file for complete search history.

(56) References Cited

U.S. PATENT DOCUMENTS 4,531,713 A * 7/1985 Balboni ..... 254/131.5
4,597,204 A 7/1986 Heiden
5,048,883 A * 9/1991 Waluk ..... 294/54.5
5,067,197 A * 11/1991 Cormier ..... 15/244.1
5,271,169 A 12/1993 Konsztowicz
5,440,828 A * 8/1995 Simpson ..... 37/285
5,493,797 A * 2/1996 Jackson ..... 37/285
5,676,413 A * 10/1997 Hauck ..... 294/54.5
5,724,755 A 3/1998 Weagley
6,735,887 B1 * 5/2004 Muzzammel ..... 37/285
2007/0187964 A1 * 8/2007 Marble ..... 294/51

* cited by examiner

*Primary Examiner*—Robert E Pezzuto
(74) *Attorney, Agent, or Firm*—Jim H. Salter

(57) ABSTRACT

Various embodiments provide an improved snow pusher with a removable friction-reducing edge. An example embodiment includes a blade having a generally rectangular shape and being of rigid material, the blade including an angled lower portion; a slider for removable attachment to the angled lower portion of the blade, the slider being fabricated from a friction-reducing material; a handle attachment mechanism for removable attachment to the blade; and a handle for removable attachment to the handle attachment mechanism.

18 Claims, 8 Drawing Sheets

SNOW PUSHER WITH A REMOVABLE FRICTION-REDUCING EDGE

TECHNICAL FIELD

The disclosed subject matter relates to the field of manual snow removal equipment.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright 2007-2008 Marc Goldman, All Rights Reserved.

BACKGROUND

Motorized machines are sometimes used for snow removal. But, such motorized devices can be too expensive and difficult to operate, especially for small jobs. The ordinary shovel is commonly used for moving snow. But, the use of a shovel requires that the snow be lifted and thrown, repeatedly. This conventional process can be too strenuous for most people.

A common alternative to the ordinary shovel is the snow pusher, in which a blade is pushed through the snow, like a hand-held snow plow. A characteristic of the snow pusher, which is unlike the snow shovel, is that during operation of the snow pusher, the device rests on the ground. People typically prefer to use a snow pusher, rather than the shovel; because, the use of the snow pusher is less arduous than a shovel. This is because the snow pusher does not require lifting and throwing the snow.

Conventional snow pushers can also be difficult to use, because the device remains in contact with the ground. If the ground is uneven or rough, it can be difficult to move the snow pusher forward. For example, when the snow pusher is used on an uneven surface, the edges and corners of the blade can become snagged in protrusions and cracks in the surface. This makes snow removal using conventional snow pushers more irritating and arduous, because of the stoppages and interruptions due to the rough surfaces.

Snow pushers have been in common use for many years. Several conventional designs are described in several U.S. Patents. For example, U.S. Pat. No. 4,245,411 describes an improved scoop type snow scraper/lifter having a length to reach at substantially a 45 degree angle from the ground to the user's hip level. The device includes a symmetrical trapezoidal shape with faired-in handgrips at the transverse upper end spaced apart at nominal human hip spacing. These critical dimensions interact with the structure to permit substantially strain-free pushing and scooping of snow by leaning or bumping urging of the unit with the hips which are cushioned by the hands on the handgrips and substantially strain-free lifting of snow scooped. Tapered construction and a spaced pair of skids make the unit less likely to cause injury if broken and quieter in operation.

U.S. Pat. No. 4,597,204 describes a manual snow pusher comprising a resilient rubber blade connected along the base of a hood-like snow diverting member of galvanized metal plate. An elongate handle is pivotally attached to a latch plate at the back of the snow diverting member, allowing the angle of the handle relative to the length of the blade to be adjusted. The handle has a spring loaded pin which can be engaged in any one of a series of holes formed around the arcuate periphery of the latch plate in order to releasably secure the handle in a selected angular position.

U.S. Pat. No. 5,271,169 describes a device including a blade and a handle whereby the device may be used as a conventional snow pusher. Skis or skids below the blade support the blade at an angle relative to the ground, and may raise the blade 5 cm or so off the ground surface, so that the blade does not snag the ground during pushing. Left and right struts support the skis from the blade. The struts are collapsible, and when collapsed the skis lie tucked away against the back of the blade, whereby the device may be used as a shovel.

U.S. Pat. No. 5,724,755 describes a snow pusher including a blade with horizontal and vertical reinforcing channels, a reversible and removable rubber edge fastened to the blade and extending below its bottom edge, and a side plate extending forward from each end of the blade. Each side plate includes a removable wear shoe with inclined ramps for sliding contact on the ground surface. Upper and lower rows of posts extend rearward from the blade to form a slot for insertion of a front end loader bucket. Connection is secured by a releasable chain.

Thus, an improved snow pusher is needed.

BRIEF DESCRIPTION OF THE DRAWINGS

Embodiments illustrated by way of example and not limitation in the figures of the accompanying drawings, in which.

DETAILED DESCRIPTION

In the following detailed description, reference is made to the accompanying drawings that form a part hereof, and in which are shown, by way of illustration, specific embodiments in which the disclosed subject matter can be practiced. It is understood that other embodiments may be utilized and structural changes may be made without departing from the scope of the disclosed subject matter.

According to various example embodiments of the disclosed subject matter as described herein, there is described an improved snow pusher with a removable friction-reducing edge. A particular embodiment includes a friction-reducing edge with angled or slanted leading and trailing edges to facilitate snow removal in a forward or reverse direction.

Figure 1:
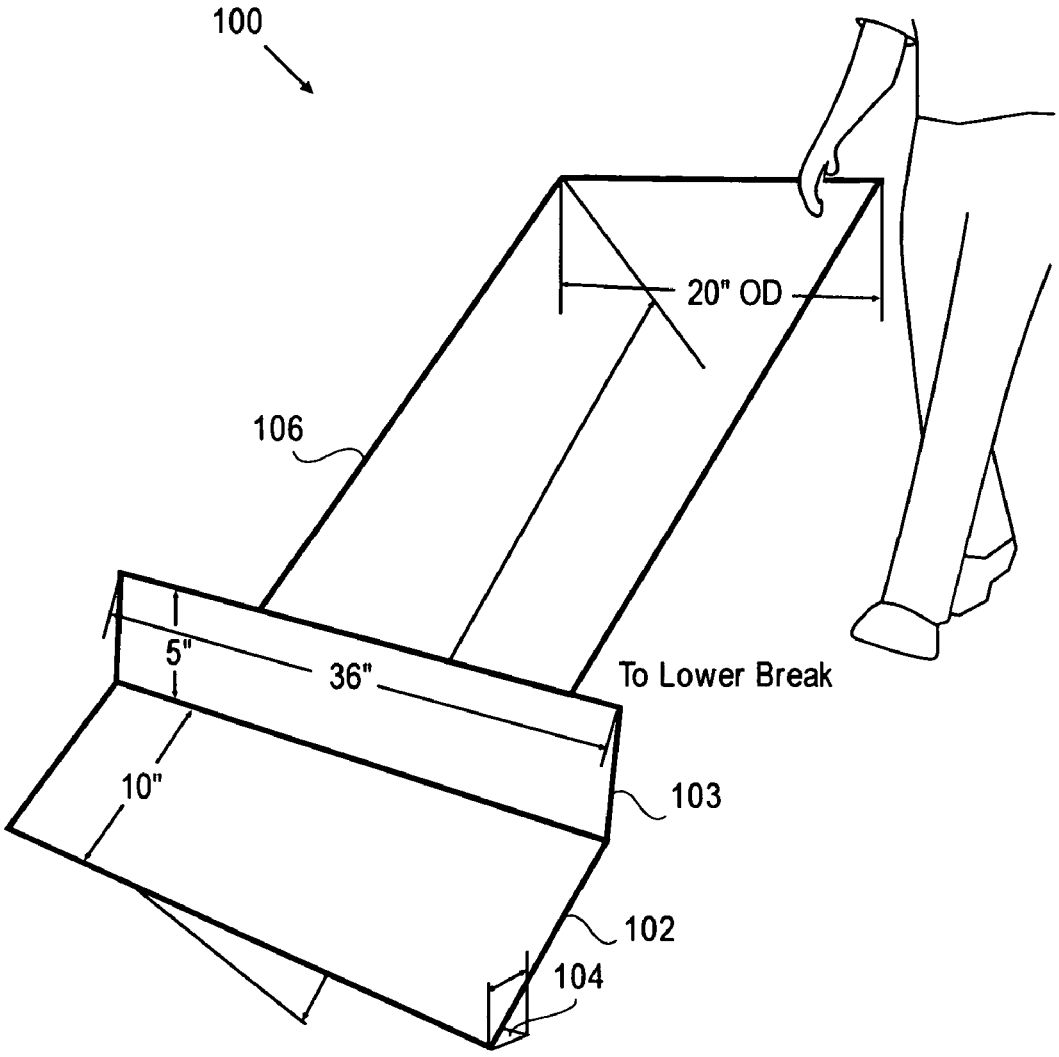
FIG. 1 illustrates a front view of an example embodiment of the improved snow pusher.
Figure 2:
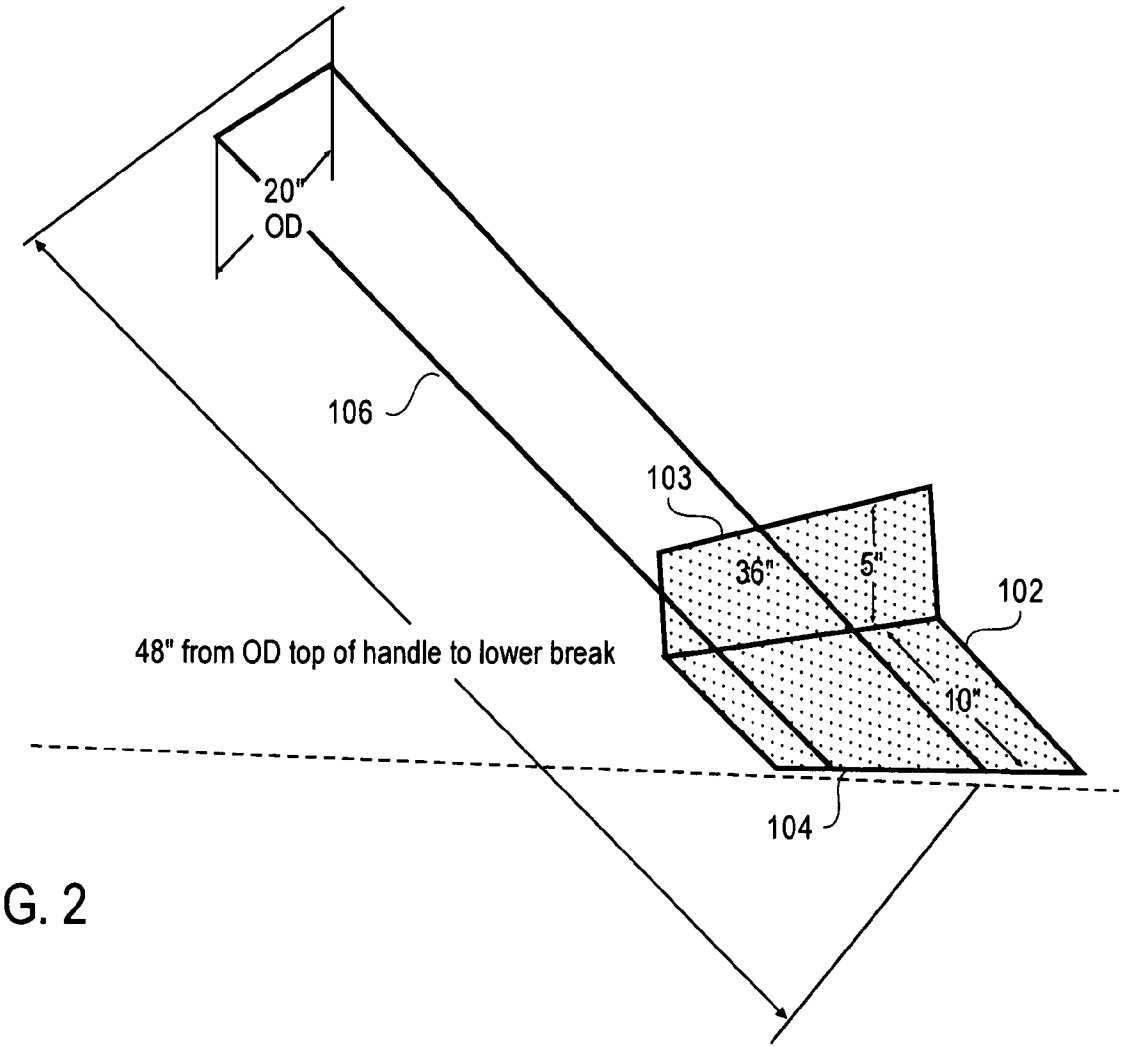
FIG. 2 illustrates a rear view of an example embodiment of the improved snow pusher.
Figure 3:
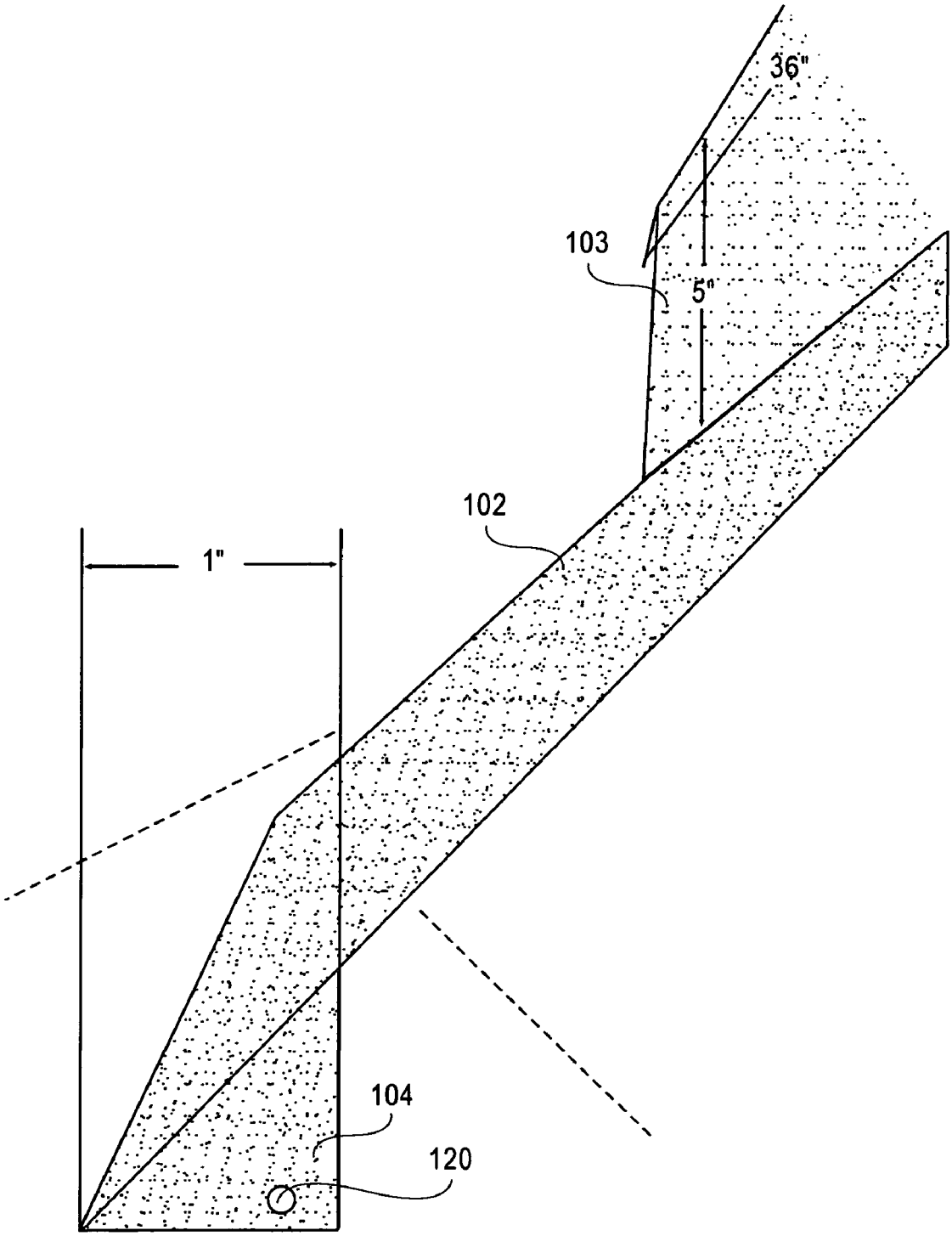
FIG. 3 illustrates a side view of the blade portion of an example embodiment of the improved snow pusher.

FIG. 1 illustrates a front view of an example embodiment of the improved snow pusher. FIG. 2 illustrates a rear view of an example embodiment of the improved snow pusher. FIG. 3 illustrates a side view of the blade portion of an example embodiment of the improved snow pusher. As illustrated in each of these figures, an example embodiment of the snow pusher 100 is shown to include a blade 102 to which a U-shaped handle 106 is attached. The U-shaped handle 106 is described in more detail below in connection with FIGS. 7-8. An embodiment of the blade 102, as shown in FIGS. 1-3, is a generally flat rectangular piece of rigid material, such as sheet metal (e.g., steel or aluminum), rigid plastic, composite material, or the like. An upper portion 103 of the blade 102 can be angled slightly forward as shown in FIGS. 1-2 to cause snow to roll forward as the snow pusher 100 is pushed forward. Alternatively, the upper portion 103 of blade 102 can be rounded or formed with multiple angles instead of being singularly angled to cause a similar effect of rolling snow forward as the snow pusher 100 is pushed forward. The particular implementation of the upper portion 103 can be determined based on the costs and ease of manufacturing the blade 102.

As also shown in FIGS. 1-3, the blade 102 includes an angled lower portion 104. The angled lower portion 104 serves several purposes in a particular embodiment. Firstly, the angled lower portion 104 reinforces the rigidity of the lower edge of the blade 102. Secondly, the angled lower portion 104 provides a sliding base for the lower edge of blade 102 on which an embodiment of the snow pusher 100 can be in contact with a surface over which the snow pusher 100 is pushed. Thirdly, the angled lower portion 104 of blade 102 of a particular embodiment serves as an attach surface for the removable friction-reducing edge, denoted herein as slider 108, as shown in FIGS. 4-5.

Figure 4:
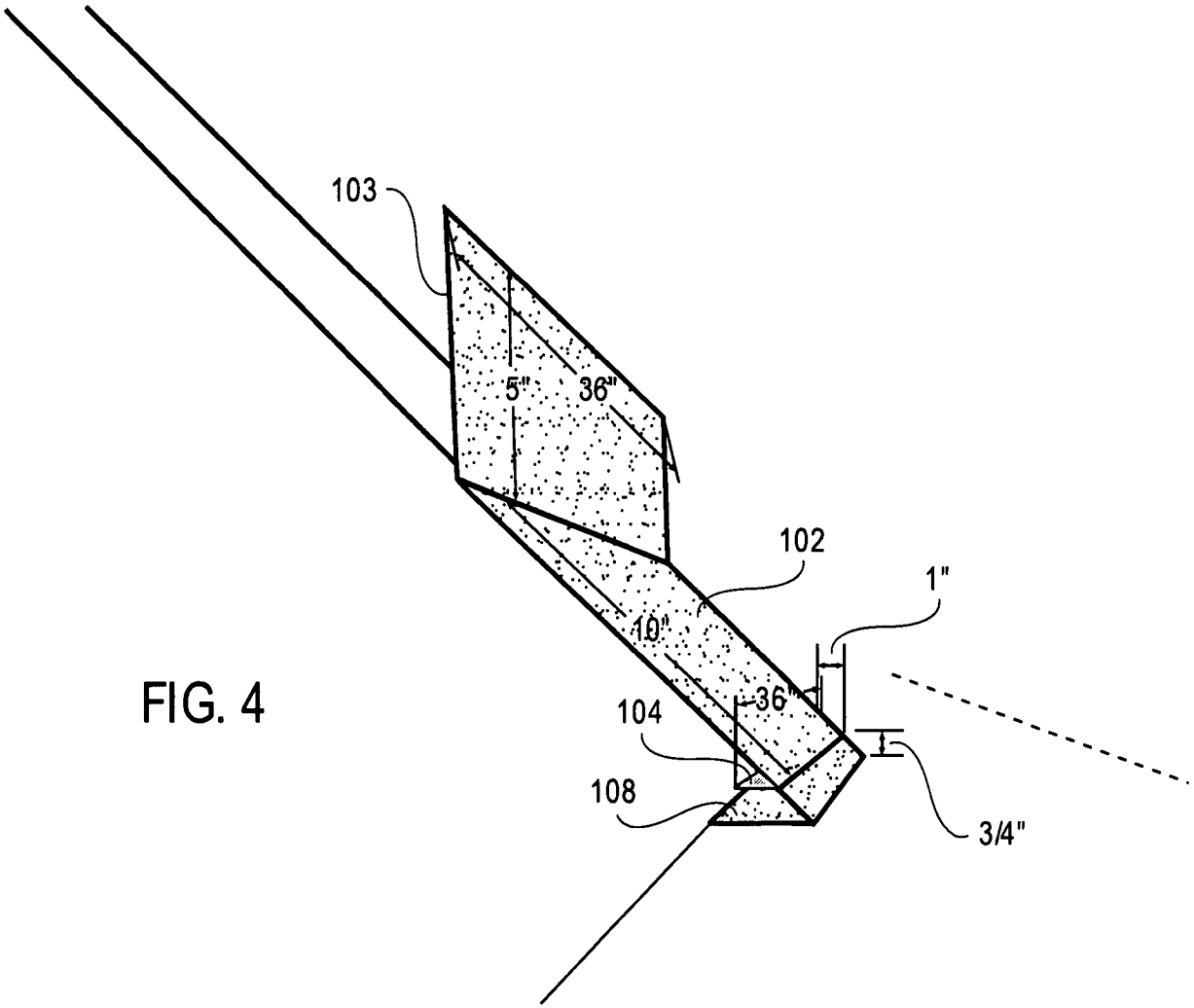
FIG. 4 illustrates a view of the blade portion of an example embodiment with the attached slider.

Referring now to FIG. 4, the slider 108 is a friction-reducing edge removably attached to an under-surface of the angled lower portion 104 of blade 102. The slider 108 can be removably attached to the angled lower portion 104 with a set of screws or bolts that attach through a plurality of holes in the angled lower portion 104. Screws or bolts can be inserted from the lower side of slider 108 up and through holes in the angled lower portion 104 of blade 102. The heads of the screws or bolts can be recessed into the slider 108 to enable the lower side of slider 108 to be flush with a surface over which the slider 108 is pushed.

Figure 5:
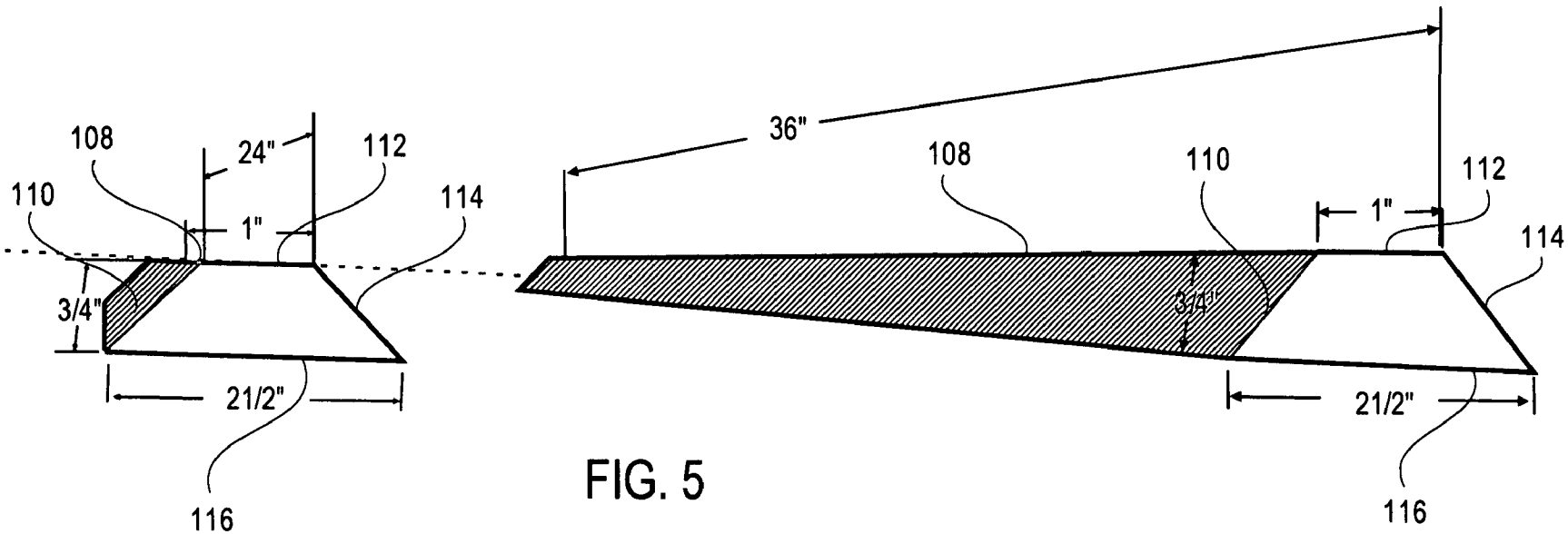
FIG. 5 illustrates a detail of the slider of a particular embodiment.

Referring to FIG. 5, the slider 108, of a particular embodiment, is a piece of High-Density Polyethylene (HDP) material. Such material is conventionally used as a structural building material. The HDP material has several useful properties that can be beneficially, but unpredictably, used for application to a snow pusher device. Firstly, the HDP material is a low-friction material that can be easily slid across high friction surfaces, such as asphalt, concrete, gravel, or uneven surfaces. As such, the use of HDP on the lower surface of the angled lower portion 104 enables a user to push the snow pusher 100 forward with a lower level of force and a lower level of consumed energy. Secondly, HDP provides a gentle edge that will not damage surfaces, thereby allowing a user to clear snow from outdoor tile, wood decks, composite decks, metal or composite roofs, and the like. HDP provides an edge that does not scratch or gouge the surface over which the snow pusher of the described embodiments is pushed. As such, the pusher of the described embodiments can also be used indoors to remove dirt, construction scraps, clutter, and the like. In contrast, metal edges on conventional shovels or pushers can damage surfaces. Thirdly, HDP is waterproof and holds up well in wet and cold environments, such as the conditions present during snow removal. Fourthly, HDP tends to beneficially wear as the snow pusher 100 is repeatedly used over time. This beneficial wearing causes the leading edge of the slider 108 to self-sharpen and to assume the proper angle relative to a consistent user of the snow pusher 100. These beneficial qualities of HDP serve to make the snow pusher 100 easier to use, require less energy during use, to be more effective for snow removal over a variety of surfaces, and to self-adapt to particular users and surface conditions over time. In other embodiments, materials other than HDP can also be used. For example, certain plastics, composite materials, or other synthetic materials having similar properties as HDP may similarly be used. However, rubber is not considered a suitable material as rubber tends to be a high friction compound requiring too much force to manually push over high friction surfaces.

The removable design of the friction-reducing edge provided by slider 108 enables the working edge of the snow pusher 108 to be replaced periodically as the edge becomes worn. The replaceable aspect of the slider 108 allows a user to keep the snow pusher 100 in peak operating condition over time. Additionally, the replaceable aspect of the slider 108 enables a user to customize the shape and composition of slider 108 for a particular surface over which the snow pusher 108 is intended to be used.

As illustrated in FIG. 5, the slider 108 of a particular embodiment can be formed in a beneficial and novel shape. Slider 108 of a particular embodiment is a generally long and narrow piece of HCP formed in a trapezoidal cross-section as shown in FIG. 5. The long dimension of the slider 108 corresponds to the width of blade 102. In one embodiment, the length of slider 108 and width of blade 102 can be 36 inches. In another embodiment, the length of slider 108 and width of blade 102 can be 24 inches. Other embodiments can be of other particular dimensions.

Referring again to FIG. 5, the slider 108 of a particular embodiment can be formed in a trapezoidal cross-section. Thus, the slider 108 can have an upper edge 112, a lower edge 116, a leading edge 110, and a trailing edge 114. As shown in FIG. 5, each of these edges is a surface or face of the slider 108. The lower edge 116 is typically of a dimension greater than the upper edge 112. The lower edge 116 is in contact with the surface on which the snow pusher 100 is being used to remove snow during its operation. The upper surface 112 is in contact with the lower surface of the angled lower portion 104 of blade 102 when the slider 108 is attached to the blade 102. The leading edge 110 is angled relative to both the upper edge 112 and the lower edge 116 to create a slanted, ramped, or wedged shape that acts to get under and lift a layer of snow when the snow pusher 100 is pushed forward. As shown in FIG. 4, for example, the angle formed between the leading edge 110 and the lower edge 116 is generally the same as the angle formed by the angled lower portion 104 of blade 102. In a particular embodiment, the trailing edge 114 is also is angled relative to both the upper edge 112 and the lower edge 116 to also create a slanted, ramped, or wedged shape that acts to get under and lift a layer of snow when the snow pusher 100 is pulled backwards. As shown in FIG. 4, for example, the plane formed by the trailing edge 114 is generally perpendicular to the plane formed by blade 102. In a particular embodiment, the angle formed between the leading edge 110 and the lower edge 116 and the angle formed between the trailing edge 114 and the lower edge 116 can be 45 degree angles. Note, however, that as the snow pusher 100 is used, the lower edge 116, which is in contact with a surface over which the snow pusher 100 is pushed, can beneficially wear down to change the angle formed between the leading edge 110 and the lower edge 116 and the angle formed between the trailing edge 114 and the lower edge 116 over time. As such, the slider 108 can self-sharpen and conform itself to the proper angle relative to a consistent user of the snow pusher 100.

Figure 6:
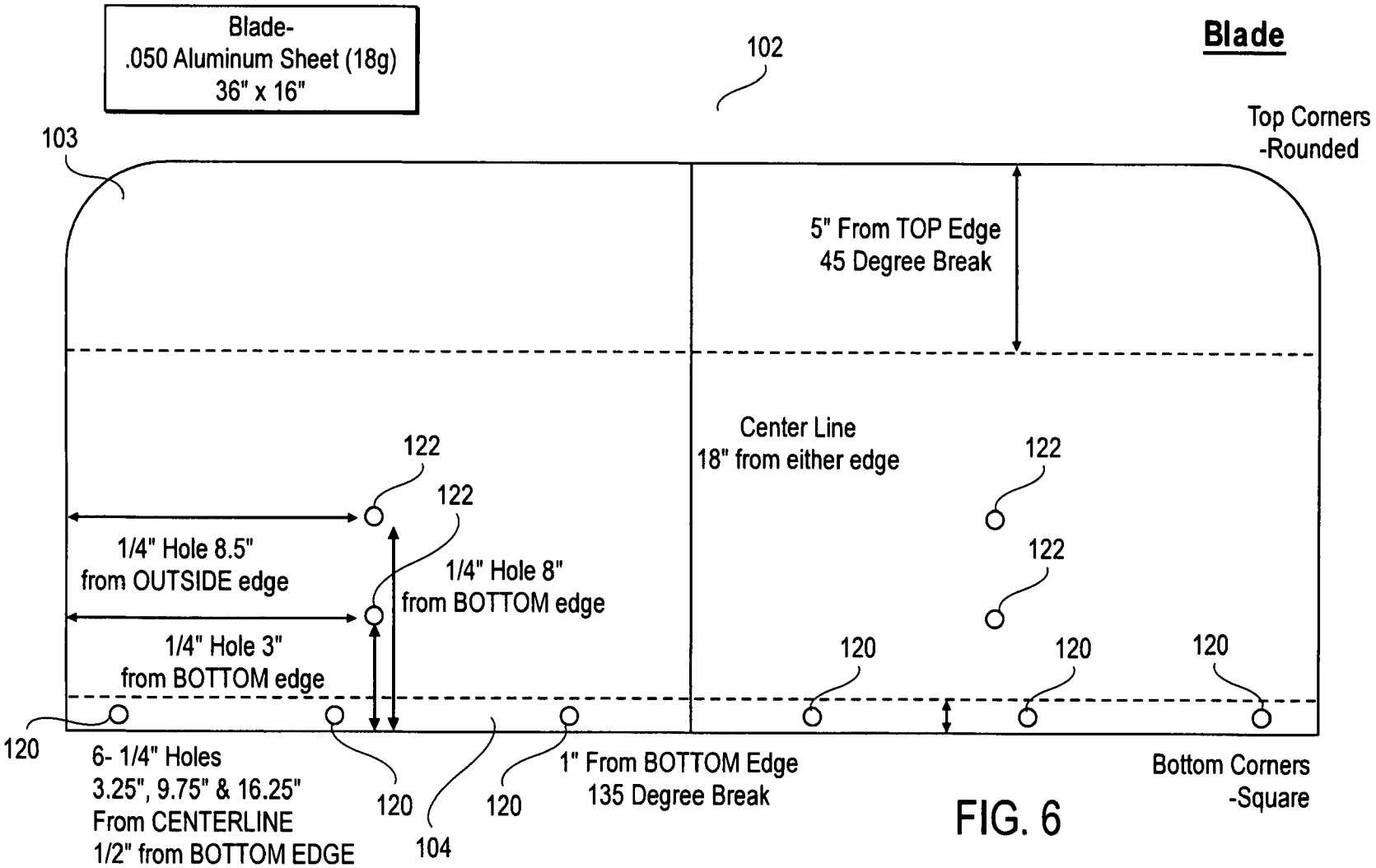
FIG. 6 illustrates a detail view of the unassembled blade portion of an example embodiment of the improved snow pusher.

FIG. 6 illustrates a detail view of the unassembled blade portion of an example embodiment of the improved snow pusher. As shown, an embodiment of the blade 102 is a generally flat rectangular piece of rigid material, such as sheet metal (e.g., steel or aluminum), rigid plastic, composite material, or the like. An upper portion 103 of the blade 102 can be angled slightly forward as shown in FIGS. 1-2 and described above. As also shown in FIG. 6, the blade 102 includes the angled lower portion 104, as also described above. The angled lower portion 104 of blade 102 of a particular embodiment serves as an attach surface for slider 108, as shown in FIGS. 4-5. Holes 120 in blade 102 are provided for removably attaching the slider 108 to the angled lower portion 104 with screws or bolts as described above. Holes 122 in blade 102 are provided for removably attaching the handle 106 to blade 102 as described below in connection with FIG. 7.

Figure 7:
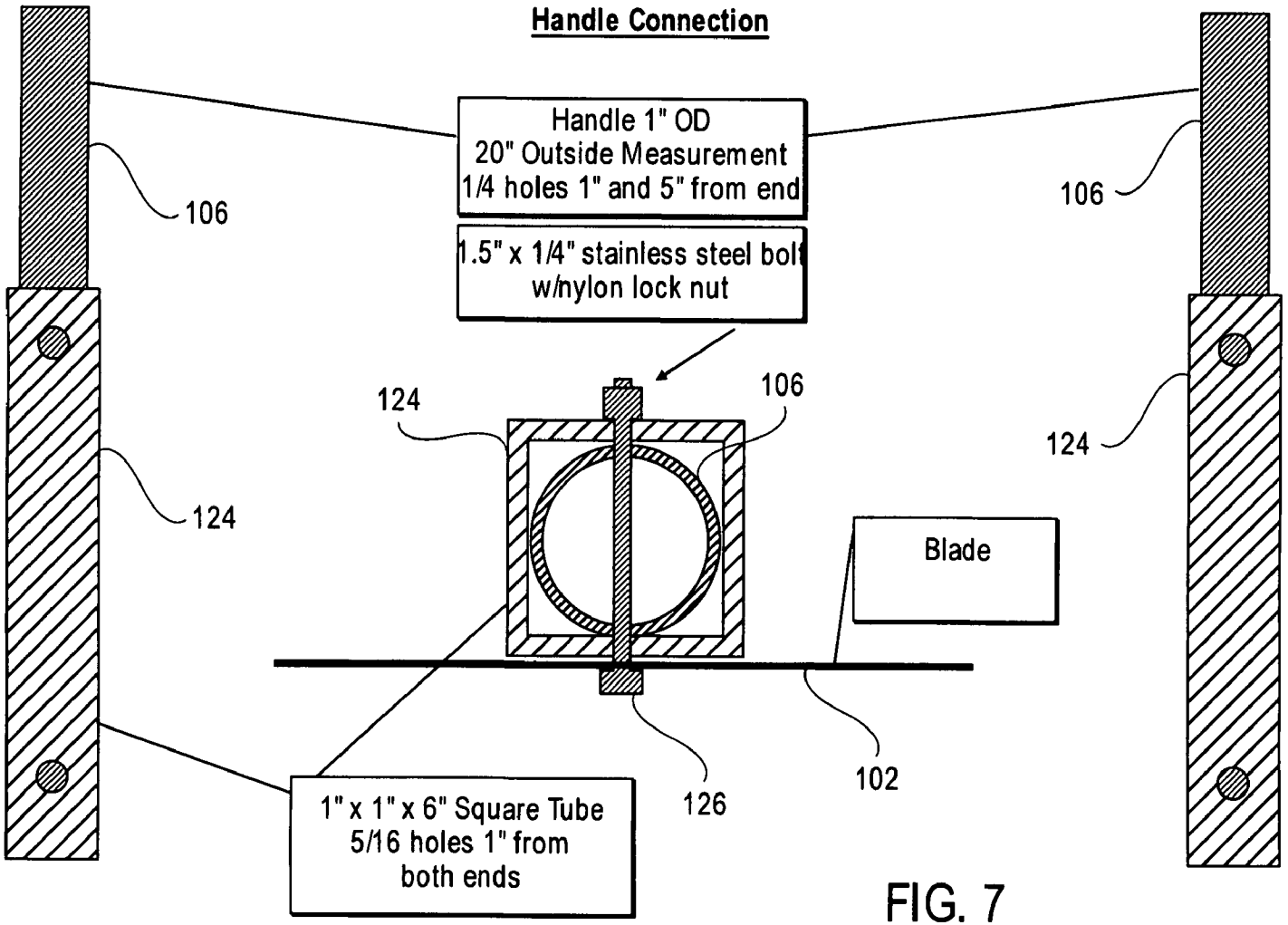
FIG. 7 illustrates the mechanism in a particular embodiment for removably attaching the handle to the blade of the improved snow pusher.

FIG. 7 illustrates the mechanism in a particular embodiment for removably attaching the handle 106 to the blade 102. As shown in FIG. 7, the handle 106 attachment mechanism includes two handle supports 124 into which ends of handles 106 can be inserted. In a particular embodiment, handle supports 124 can be generally rectangular, 1 inch by 1 inch, hollow tubes with an inside dimension of a sufficient size to receive the ends of handles 106 as shown in FIG. 7. In an alternative embodiment, handle supports 124 can be a round, hollow tube. Once the ends of handles 106 are inserted into the two handle supports 124, bolts 126 can be inserted through holes 122 in blade 102, through holes in the handle supports 124, and through holes in the ends of handles 106 as shown in FIG. 7. The bolts 126 can be secured with lock nuts to keep the handle firmly attached to the blade 102 via handle supports 124. In the configuration shown in FIG. 7, force applied to handles 106 by a human pushing the snow pusher 100 will be effectively transferred to the blade 102 causing the blade 102 to move forward over a surface thereby scraping snow from the surface. Additionally, simple removal of bolts 126 enables the detachment of handles 106 from blade 102 for easy storage or shipment of snow pusher 100.

Figure 8:
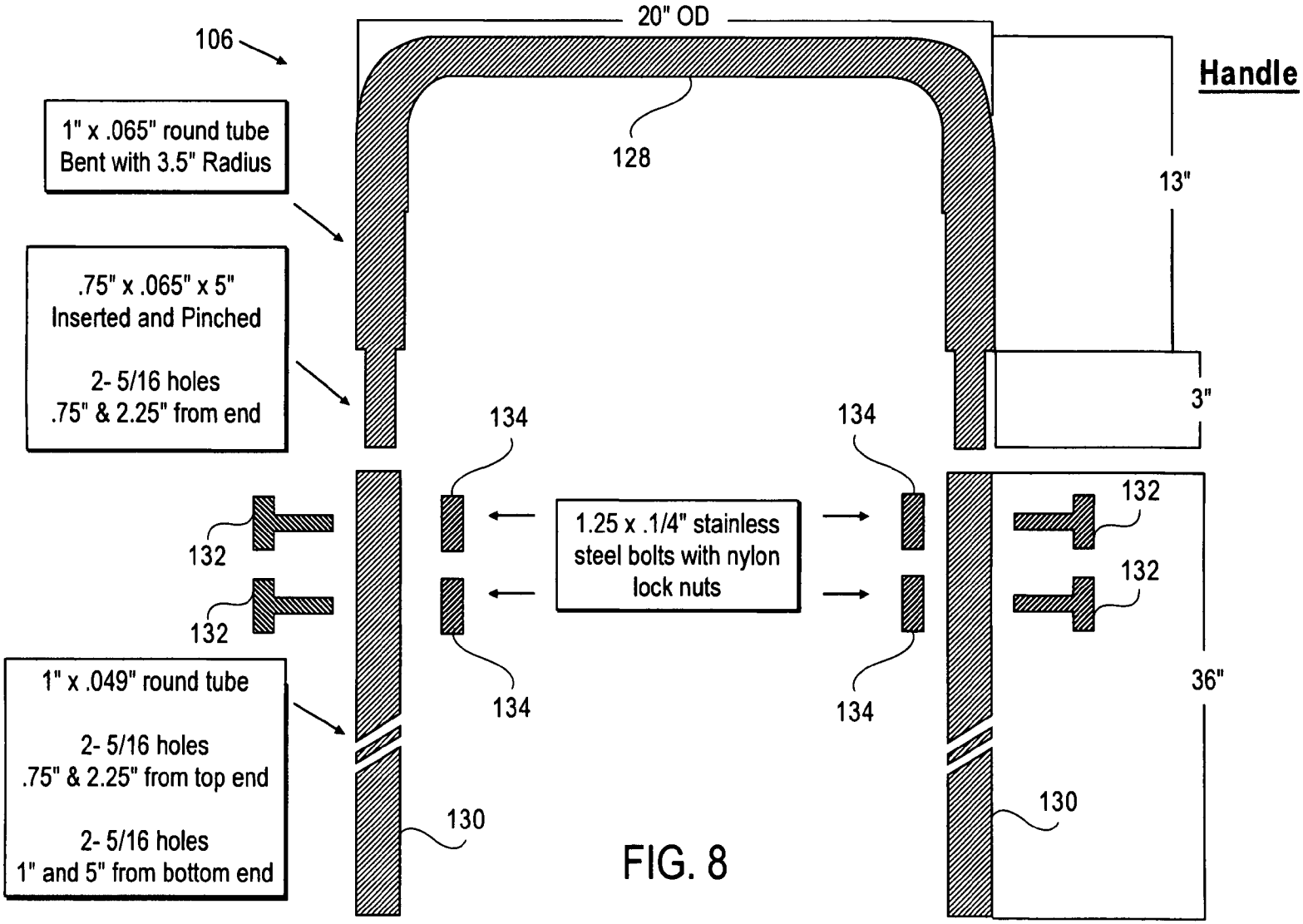
FIG. 8 illustrates the upper handle attachment mechanism of a particular embodiment.

FIG. 8 illustrates the upper handle 106 attachment mechanism of a particular embodiment. As shown, an upper handle component 128 can be removably attached to a lower handle component 130. The lower ends of upper handle component 128 can be tapered or of a reduced dimension to fit into hollow upper ends of lower handle component 130 as shown in FIG. 8. Once the upper handle component 128 is inserted into the hollow upper ends of lower handle component 130, the upper handle component 128 can be secured to the lower handle component 130 with bolts 132. Bolts 132 can be inserted through holes provided in the lower ends of upper handle component 128 and corresponding holes in the upper ends of lower handle component 130. Bolts can be secured with nuts 134. In the configuration shown in FIG. 8, simple removal of bolts 132 enables the detachment of the upper handle component 128 from the lower handle component 130 for easy storage or shipment of snow pusher 100.

During operation of the snow pusher 100 of an example embodiment as shown in FIG. 1, a user can comfortably hold the handle 106 while walking forward with the blade 102 of the snow pusher 100 resting on the surface being scraped. As a result, the blade 102 will push snow on the surface to either side of the blade 102 and thereby clear a path on the surface. The user can angle the blade 102 to one side or the other to force the snow to accumulate on a desired side of the blade 102. This angling of the blade 102 does not require any additional hardware or mechanical adjustments to accomplish. The user can also hold the handle 106 while walking backwards with the blade 102 of the snow pusher 100 resting on the surface being scraped. Because of the novel shape of the slider 108, the snow pusher 100 will also remove snow in the reverse direction.

The illustrations of embodiments described herein are intended to provide a general understanding of the structure of various embodiments, and they are not intended to serve as a complete description of all the elements and features of components and systems that might make use of the structures described herein. Many other embodiments will be apparent to those of ordinary skill in the art upon reviewing the description provided herein. Other embodiments may be utilized and derived, such that structural and logical substitutions and changes may be made without departing from the scope of this disclosure. The figures herein are merely representational and may not be drawn to scale. Certain proportions thereof may be exaggerated, while others may be minimized. Accordingly, the specification and drawings are to be regarded in an illustrative rather than a restrictive sense.

The description herein may include terms, such as "up", "down", "upper", "lower", "first", "second", etc. that are used for descriptive purposes only and are not to be construed as limiting. The elements, materials, geometries, dimensions, and sequence of operations may all be varied to suit particular applications. Parts of some embodiments may be included in, or substituted for, those of other embodiments. While the foregoing examples of dimensions and ranges are considered typical, the various embodiments are not limited to such dimensions or ranges.

The Abstract is provided to comply with 37 C.F.R. §1.74(b) to allow the reader to quickly ascertain the nature and gist of the technical disclosure. The Abstract is submitted with the understanding that it will not be used to interpret or limit the scope or meaning of the claims.

In the foregoing Detailed Description, various features are grouped together in a single embodiment for the purpose of streamlining the disclosure. This method of disclosure is not to be interpreted as reflecting an intention that the claimed embodiments have more features than are expressly recited in each claim. Thus the following claims are hereby incorporated into the Detailed Description, with each claim standing on its own as a separate embodiment.

Thus, as described above, an improved snow pusher with a removable friction-reducing edge is disclosed. Although the disclosed subject matter has been described with reference to several example embodiments, it may be understood that the words that have been used are words of description and illustration, rather than words of limitation. Changes may be made within the purview of the appended claims, as presently stated and as amended, without departing from the scope and spirit of the disclosed subject matter in all its aspects. Although the disclosed subject matter has been described with reference to particular means, materials, and embodiments, the disclosed subject matter is not intended to be limited to the particulars disclosed; rather, the subject matter extends to all functionally equivalent structures, methods, and uses such as are within the scope of the appended claims.

I claim:

1. An apparatus comprising:

a blade having a generally rectangular shape and being of rigid material, the blade including an angled lower portion;

a slider, having an attachment edge and a lower surface, for removable attachment to the angled lower portion of the blade at the attachment edge of the slider, the slider being a generally long and wide piece of friction-reducing material without parts moving relative to each other, the slider being formed of a friction-reducing high-density polyethylene material, the lower surface being a flat planar surface, which is generally parallel to a surface over which the slider is moved such that the slider provides slanted leading and trailing edges when moved in either a forward or backward direction, the slanted leading edge forming a first acute angle relative to the flat planar surface of the lower surface, the slanted trailing edge forming a second acute angle relative to the flat planar surface of the lower surface, the first acute angle and the second acute angle both being fixed acute angles and both being concurrently present, the leading and trailing edges being self-sharpening as the slider is moved across the surface;

a handle attachment mechanism for removable attachment to the blade; and a handle for removable attachment to the handle attachment mechanism.

2. The apparatus as claimed in claim 1 wherein the angled lower portion of the blade includes holes for removably attaching the slider to the blade.

3. The apparatus as claimed in claim 1 wherein the width of the slider enables a user to clear any desired depth of snow in horizontal layers.

4. The apparatus as claimed in claim 1 wherein the width of the slider enables a user to clear material on uneven surfaces.

5. The apparatus as claimed in claim 1 wherein the handle attachment mechanism is a generally rectangular hollow tube.

6. The apparatus as claimed in claim 1 wherein the blade is fabricated from a rigid light-weight material.

7. The apparatus as claimed in claim 1 wherein the blade includes an angled forward upper portion.

8. The apparatus as claimed in claim 1 wherein the handle attachment mechanism includes handle supports for receiving ends of the handle.

9. The apparatus as claimed in claim 1 wherein the handle includes an upper handle component removably attachable to a lower handle component.

10. The apparatus as claimed in claim 1 wherein a user can angle the blade to push snow on the surface to a desired side of the blade.

11. An apparatus comprising:

a blade means having a generally rectangular shape and being of rigid material, the blade including an angled lower portion;

a slider means, having an attachment edge and a lower surface, for removable attachment to the angled lower portion of the blade means at the attachment edge of the slider means, the slider means being a generally long and wide piece of friction-reducing material without parts moving relative to each other, the slider means being formed of a friction-reducing high-density polyethylene material, the lower surface being a flat planar surface, which is generally parallel to a surface over which the slider means is moved such that the slider means provides slanted leading and trailing edges when moved in either a forward or backward direction, the slanted leading edge forming a first acute angle relative to the flat planar surface of the lower surface, the slanted trailing edge forming a second acute angle relative to the flat planar surface of the lower surface, the first acute angle and the second acute angle both being fixed acute angles and both being concurrently present, the leading and trailing edges being self-sharpening as the slider means is moved across the surface;

a handle attachment means for removable attachment to the blade means; and a handle means for removable attachment to the handle attachment means.

12. The apparatus as claimed in claim 11 wherein a user can angle the blade means to push snow on the surface to a desired side of the blade means.

13. The apparatus as claimed in claim 11 wherein the angled lower portion of the blade means includes holes for removably attaching the slider means to the blade means.

14. The apparatus as claimed in claim 11 wherein the handle attachment means is a generally rectangular hollow tube.

15. The apparatus as claimed in claim 11 wherein the handle means includes an upper handle component removably attachable to a lower handle component.

16. The apparatus as claimed in claim 11 wherein the handle attachment means includes handle supports for receiving ends of the handle means.

17. The apparatus as claimed in claim 11 wherein the blade means is fabricated from a rigid light-weight material.

18. The apparatus as claimed in claim 11 wherein the blade means includes an angled forward upper portion.

* * * * *